US011085256B2

(12) United States Patent
Holtby

(10) Patent No.: US 11,085,256 B2
(45) Date of Patent: Aug. 10, 2021

(54) SELF CLEANING DRILLING RIG FLUID CONTAINMENT

(71) Applicant: Katch Kan Holdings Ltd., Edmonton (CA)

(72) Inventor: Quinn A. J. Holtby, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 0 days.

(21) Appl. No.: 16/663,144

(22) Filed: Oct. 24, 2019

(65) Prior Publication Data

US 2021/0123308 A1 Apr. 29, 2021

(51) Int. Cl.
*E21B 21/01* (2006.01)
*E21B 41/00* (2006.01)

(52) U.S. Cl.
CPC ..... *E21B 21/01* (2013.01); *E21B 41/0021* (2013.01)

(58) Field of Classification Search
CPC ..... E21B 33/08; E21B 21/01; E21B 33/03; E21B 41/005; E21B 41/0021
USPC ..... 166/81.1, 379
See application file for complete search history.

(56) References Cited

U.S. PATENT DOCUMENTS 3,140,828 A 7/1964 Galanor
5,211,244 A 5/1993 Arterbury
5,228,506 A * 7/1993 Pearce ..... E21B 33/08 166/81.1
5,315,721 A 5/1994 Okun
5,377,748 A * 1/1995 Gayaut ..... E21B 21/01 166/162
5,387,736 A 2/1995 Salomone et al.
6,286,593 B1 9/2001 Holtby
6,386,225 B1 5/2002 Holtby
6,415,861 B1 * 7/2002 Harrison, Jr. ..... E21B 33/08 166/81.1
6,666,287 B2 12/2003 Holtby
7,409,995 B2 * 8/2008 Moynahan ..... E21B 17/006 166/311
10,392,895 B1 8/2019 Pruitt et al.
2002/0179300 A1 * 12/2002 Gay ..... E21B 33/08 166/81.1
2007/0169931 A1 * 7/2007 Holthe ..... E21B 43/127 166/81.1
2017/0022787 A1 1/2017 Holtby

FOREIGN PATENT DOCUMENTS

WO WO-2012140446 A2 * 10/2012 ..... E21B 21/10

OTHER PUBLICATIONS

"General Maintenance Absorbent Drip Pan," Can-Ross Environmental Services Ltd., Ontario, Canada, <http://www.canross.com/product/general-maintenance-absorbent-drip-pan-10-5-x-10-5-8-case> [retrieved Aug. 12, 2019], 5 pages.

(Continued)

*Primary Examiner* — James G Sayre
(74) *Attorney, Agent, or Firm* — Christensen O'Connor Johnson Kindness, PLLC

(57) ABSTRACT

A self cleaning leak containment apparatus for an oil drilling rig includes nozzles to direct jets of cleaning fluid into the apparatus. The self cleaning leak containment apparatus can include a tray with nozzles fed by pumps that also serve to drain the tray. A sheet-form around the tray and draining into the tray can also have nozzles directed into it.

9 Claims, 4 Drawing Sheets

(56) References Cited

OTHER PUBLICATIONS

"Mats" Can-Ross Environmental Services Ltd., Ontario, Canada, <http://www.canross.com/product-catagoryabsorbents/mats> [retrieved Aug. 12, 2019], 5 pages.
"Drain Inserts—Enviro Drain®," Can-Ross Environmental Services Ltd., Ontario, Canada, <http://www.canross.com/product/drain-inserts-enviro-drain> [retrieved Aug. 12, 2019], 5 pages.
"Leak Diverter Kit," Can-Ross Environmental Services Ltd., Ontario, Canada, <http://www.canross.com/product/leak-diverter-kit-10ft x 10ft-1-case> [retrieved Aug. 12, 2019], 5 pages.
"Mobile Mat Washing—Industrial Mat Cleaning System," Newpark, The Woodlands, Texas,<http://www.newpark.com/mobile-mat-washing> [retrieved Aug. 12, 2019], 1 page.
"Rig Washing," Newpark, The Woodlands, Texas, <http://www.newpark.com/rig-washing> [retrieved Aug. 12, 2019], 1 page.
"Oil & Gas Field Systems," Riveer,™ South Haven Mississippi, 8-page brochure, at least as early as Aug. 12, 2019.
"SPI "Sealed" and Portable Containment Liners," Solidification Products International, Inc., Northford, Connecticut, <https://www.oilbarriers.com/portable-containment-liners> [retrieved Aug. 12, 2019], 9 pages.
"Swift Saver™ Drilling Fluid Containment & Recovery System," Swift Environmental, Edmonton, Canada, 12-page brochure, at least as early as Aug. 12, 2019.

* cited by examiner

SELF CLEANING DRILLING RIG FLUID CONTAINMENT

TECHNICAL FIELD

Rig spill containment

BACKGROUND

The inventor has previously developed methods and apparatus for enclosing a rig structure (CA patent 2,360,234, U.S. Pat. No. 6,666,287; CA patent application 2,936,599, US patent publication 2017/0022787) and leak containment pans and methods (CA patent 2,136,375, U.S. Pat. No. 5,634,485; CA patent 2,166,265, U.S. Pat. No. 5,937,947; CA patent 2,258,064, U.S. Pat. No. 6,286,593; CA patent 2,355,002, U.S. Pat. No. 6,386,225).

It would be desirable to be able to more conveniently clean the interiors of enclosing structures and containment pans.

SUMMARY

There is provided a drilling rig leak containment apparatus having a tray. The tray includes a platform and a sidewall around the platform. The tray is configured to be positioned around a central stack of a drilling rig. The leak containment apparatus includes jet nozzles mounted within the tray, and one or more fluid supply pumps connected to supply cleaning fluid to the jet nozzles.

There is also provided another drilling leak containment apparatus having a tray, the tray including a platform and a sidewall around the platform, the tray configured to be positioned around a central stack assembly of a drilling rig. This drilling leak containment apparatus includes a flexible sheet-form having a first edge secured to or within the sidewall using a sealing connection and a second edge secured in spaced relation to the tray. The apparatus also includes jet nozzles configured to be connected to a cleaning fluid supply source and directed within the flexible sheet-form.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Self-Cleaning Adjustable Containment Enclosure

There is provided a self-cleaning adjustable containment enclosure (SC-ACE™) to be used in all locations where a standard adjustable containment enclosure (ACE™) is utilized, for example an adjustable containment enclosure as disclosed in CA patent 2,360,234, U.S. Pat. No. 6,666,287; or in CA patent application 2,936,599, US patent publication 2017/0022787.

The enclosure includes a flexible sheet-form arranged around a drilling rig structure. The sheet-form connects to a tray for catching leaks, which may be for example a Katch Kan™ tray such as the self-cleaning low profile Katch Kan™ tray disclosed below. The SC-ACE™ incorporates the use of pressurized jets to actively clean the interior of the ACE™ as well as clean the central stack which the SC-ACE™ encloses using a cleaning fluid of choice. Accompanying pumps will channel the fluid through the pressurized jets.

Figure 1:
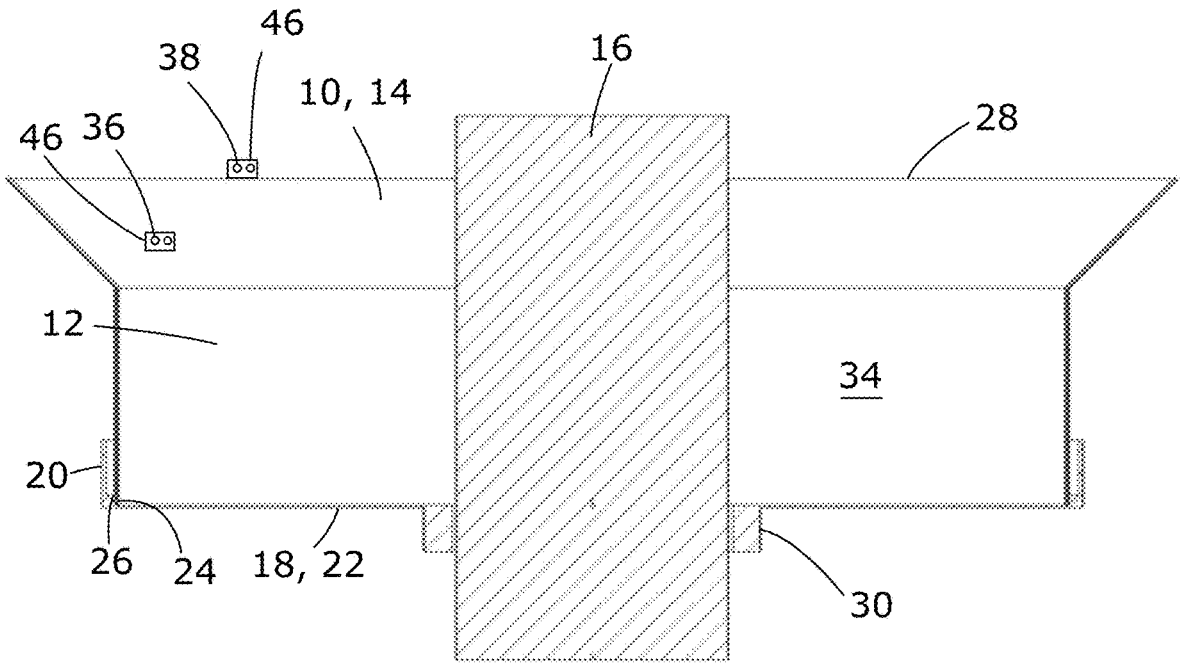
FIG. 1 is a side view of a self-cleaning adjustable containment enclosure.

FIG. 1 shows an exemplary self-cleaning adjustable containment enclosure. The SC-ACE™ in this example comprises flexible sheet-form 10 having a generally cylindrical portion 12 and a generally frustoconical portion 14, but different shapes can be used. The flexible-sheet form is arranged around a central stack assembly 16 of the drilling rig. The central stack assembly 16 shown is shown in FIG. 1 as a box standing representing any open substructure found beneath any type of rig, which may include for example a "christmas tree" of the drilling rig. The flexible sheet-form is connected to a tray 18 also arranged around the central stack assembly 16 and having a sidewall 20 around a platform 22. A first edge 24 of the flexible sheet-form 10 connects to the tray 18 using a sealing connection 26 and may connect to or within the sidewall 20. Here and throughout this document, "or" is used in the inclusive sense. The sealing connection may be semi-permeable or watertight, and may include for example, but is not limited to, sealing systems such as hook-and-loop fasteners such as Velcro™. Velcro™ can be used with additional sealing means, and can seal directly against some cleaning solutions. The tray may also have a collar 30 around the central stack assembly 16.

Figure 2:
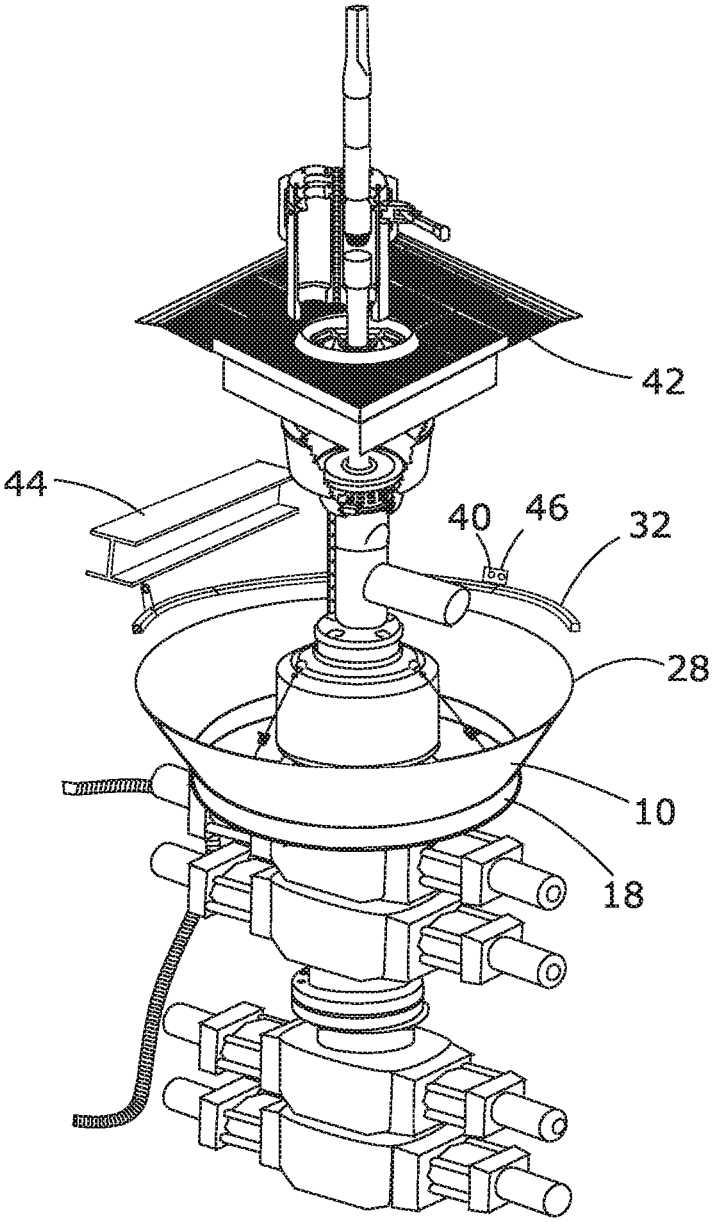
FIG. 2 is a perspective view of another embodiment of a self-cleaning adjustable containment enclosure, also showing other components of an oil drilling rig.

A second edge 28 of the flexible sheet-form 10 is secured in spaced relation to the tray, for example by connection to a support bar positioned in spaced relation to the tray 18. FIG. 2 shows an exemplary SC-ACE™ having a support bar 32. The support bar 32 may be a metal support bar and may for example be mounted beneath a rig floor deck 42 and may be secured to a rig structural element 44. The second edge of the SC-ACE™ may be fixed to the surrounding structure 44, rig floor deck 42, or the support bar 32 through the use of an attachment mechanism such as hook-and-loop fasteners including Velcro™.

The SC-ACE™ comprises jet nozzles configured to be connected to a cleaning fluid supply source to direct cleaning fluid within the flexible sheet-form. The jet nozzles may be mounted on an interior surface 34 of the flexible sheet-form, as shown for exemplary nozzles 36, or they may be mounted on the second edge 28 of the SC-ACE™, as shown for exemplary nozzles 38, or they may be mounted on the support bar 32, as shown for exemplary nozzles 40 in FIG. 2. The nozzles are not necessarily drawn to scale and the number and size of nozzles may vary. The nozzles may be grouped into one or more pressurized jet assemblies 46.

The Pressurized Jet Assemblies may be mounted either within the SC-ACE™ assembly vertically or along its inner radius or along the upper metal support bar at the top of the SC-ACE™. These pressurized jet assemblies will channel cleaning fluid provided by an accompanying pump system (not shown in FIGS. 1 and 2) through nozzles to clean the interior of the SC-ACE™ as well as the central stack assembly. The pump system can be for example pumps of a self-cleaning Low Profile Katch Kan™ tray as described below, or a separate pump system. The type of pump used, as well as its technical specifications will vary depending on the application and operational requirements. Cleaning fluid and methodology will also vary depending on user requirements.

The type of nozzles mounted on the pressurized jet assembly, such as static, reciprocating, adjustable, etc. will vary depending on application and operational requirements. Depending on operational requirements, the Pressurized Jet assembly may be adjustable to allow for dynamic positioning.

The cleaning fluid can then be collected through the tray 18.

The tray 18 may be for example a Low-Profile Katch Kan™ such as the self-cleaning Low-Profile Katch Kan™ as described below. It can also be any equivalent structure. The enclosure may be formed to be adjustable to a wide range of diameters as well as heights as disclosed for example in CA patent 2,360,234, U.S. Pat. No. 6,666,287; or in CA patent application 2,936,599, US patent publication 2017/0022787. The discussed design is applicable for all size ranges.

Self-Cleaning Low-Profile Katch Kan™

There is provided a self-cleaning low-profile Katch Kan™ (SCLP™) tray. The tray can be utilized in all locations where a standard $2^{nd}$ Stage Low Profile Load Rated Katch Kan™ is utilized, including the position of the tray 18 around a central stack of a drilling rig in FIGS. 1 and 2. The SCLP™ will incorporate the use of pumps at all drain box locations to allow for active draining of collected fluid (versus the current passive, gravity driven drainage system) as well as the use of pressurized jets which can be used to actively clean the SCLP™ using a cleaning fluid of choice.

Figure 3:
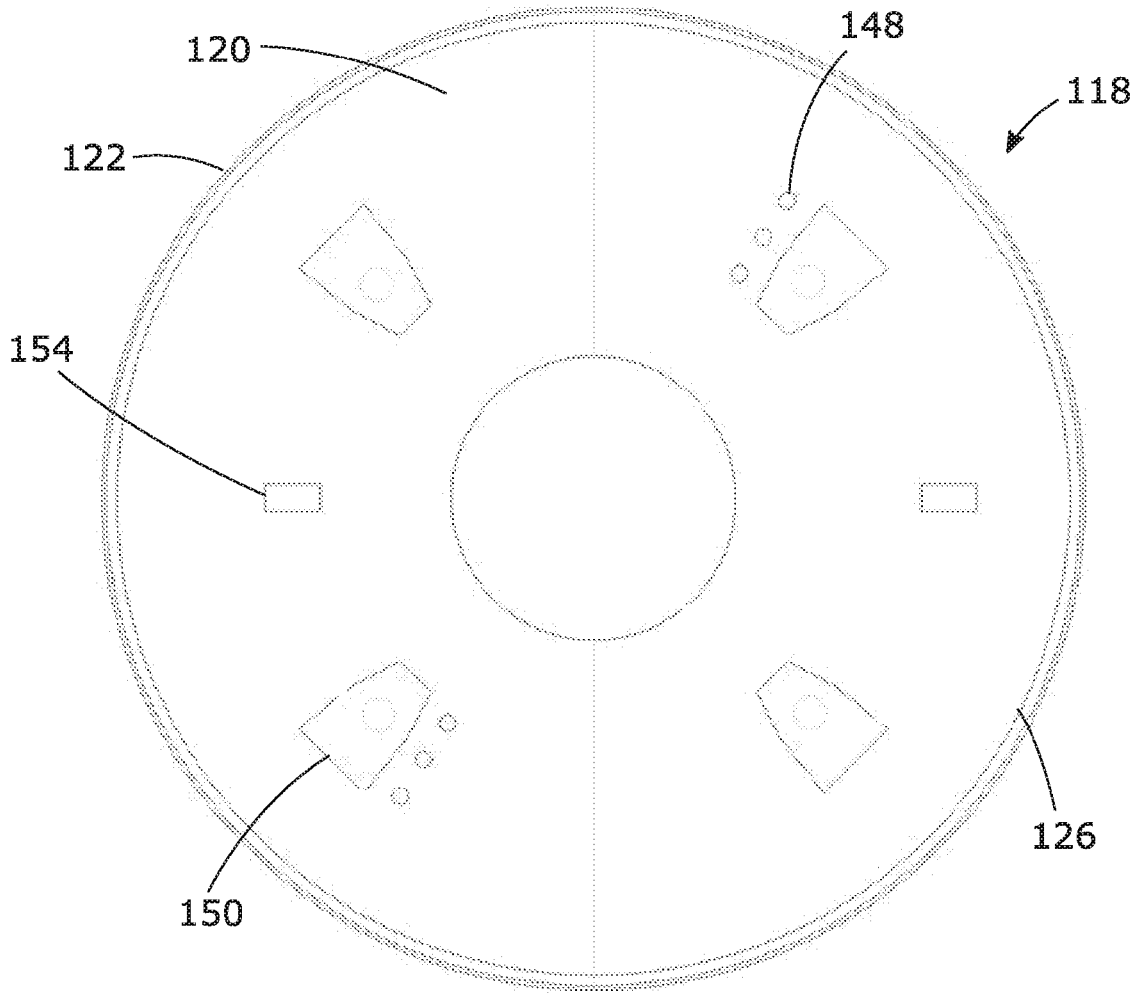
FIG. 3 is a top view of a self-cleaning low profile Katch Kan™ tray.
Figure 4:
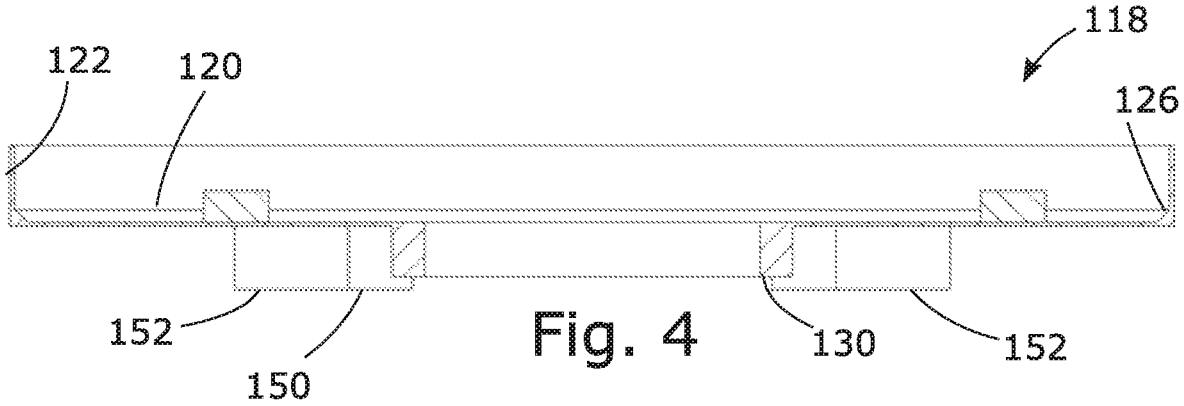
FIG. 4 is a side view of the self-cleaning low profile Katch Kan™ tray of FIG. 3.

FIG. 3 is a top view and FIG. 4 is a side view of an SCLP™ tray 118. The SCLP™ 118 includes a platform 122 with a sidewall 120 around the platform and can include a collar 130 to be arranged around a central stack of a drilling rig.

For the purpose of clarity, the shown SCLP™ 118 has been simplified in the displayed drawing. In particular, details of the drain box design have been omitted for clarity purposes. The Low-Profile Katch Kan™ function and design may be identical to the existing design with modifications as described below to allow for self-cleaning.

Nozzles 148 may be installed within the tray 118 to produce jets of cleaning fluid. As shown in FIG. 3, the platform 122 may include openings to accommodate the pressurized cleaning jets. The jets may be formed by nozzles 148 projecting through openings in the platform 122. In FIG. 3, each nozzle with the corresponding opening is together represented by a small circle. The Low-Profile Katch Kan™ may also possess a water tight seal mechanism 126 near the interface between the Low-Profile Katch Kan™'s wall 120 and base 122 which is to be used in conjunction with the Self-Cleaning Adjustable Containment Enclosure™ described above.

The SCLP™ 118 may have one or more drain boxes 150 extending below the platform 122 to allow fluid to drain from the platform 122 to the drain boxes 150. One or more pumps 152 may be installed having inlets in the drain boxes to actively drain the SCLP™ of fluid. In an embodiment, each drain box 150 may be drained by a respective pump 152 in the drain box itself, as shown in FIG. 4. The flow capacity and technical specifications of the installed pumps will vary depending on operational requirements. In the embodiment shown all installed pumps are designed to actively drain the Low-Profile Katch Kan™ of fluid, and select pumps can also be used to pump cleaning solution through the nozzles.

The cleaning fluid can be supplied either through selected installed pumps 152 or a separate dedicated pump system (not shown). In the case of selected pumps 152 operating to supply cleaning fluid to the nozzles, the remaining pumps would operate to drain the SCLP™. The pumps 152 can also be connected to supply fluid to the nozzles of the SC-ACE™. When used together, the SC-ACE™ nozzles 36, 38, 40 and SCLP™ nozzles 148 can be supplied by the same or different pumping system.

A set of pressurized jet nozzles 148 will be located within the platform of low-profile Katch Kan™. The placement of the nozzles will be dependent on its application and may vary depending on user requirements. These pressurized jet nozzles will discharge a cleaning fluid of choice across the interior of the Low-Profile Katch Kan™ in which it can be collected by the pumps 152. In an embodiment, three pressurized cleaning jets or more are located for each pair of drain box pump with the pressurized cleaning jet design and specifications to vary depending on operational requirements. The jets will be used to create a washing effect within the Low-Profile Katch Kan™ to facilitate cleaning operations.

The nozzles may each be connected to a respective pump, and in the embodiment shown are positioned near the drain box 150 of the pump 152 to which they are connected. In the embodiment shown, two of the four drain boxes have nozzles nearby, reflecting that in this embodiment two of the four pumps have nozzles connected and two do not.

Figure 5:
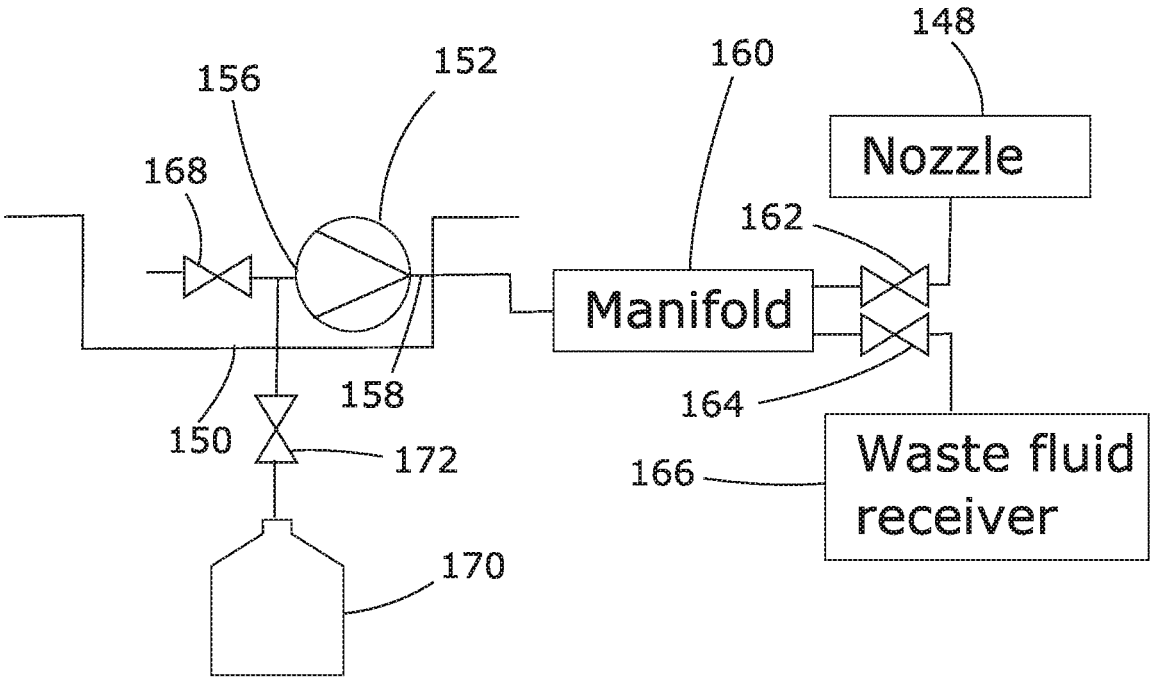
FIG. 5 is a schematic diagram of an exemplary arrangement of fluid flow components for the tray of FIG. 3.

Each pump 152 will also be equipped with a manifold (or equivalent) type of system complete with cut-off valves to regulate and control pump flow rates. The design of the manifold system as well as the valve types will vary depending on application, expected flow rates, and fluid type. All, some, or none of the pumps may be connected to manifolds. In an embodiment, the pumps with nozzles connected have manifolds. The nozzles may be connected to the pumps via the manifolds. In the embodiment shown, each pump is connected to a single respective manifold. FIG. 5 shows a schematic of an exemplary arrangement. A pump 152 in a drain box 150 has an inlet 156 connected to collect fluid from the drain box 150. The pump can be connected to collect fluid from the drain box, for example, by virtue of the pump 152 being in the drain box 150. The pump 152 has an outlet 158 connected to a manifold 160. Flow from the manifold is controlled in this embodiment by a first shut off valve 162 connected to one or more nozzles 148 and a second shut off valve 164 connected to a waste fluid receiver 166. Where a pump 152 is used at different times both for draining and pumping cleaning fluid, it can switch between these operations by various means. As shown in FIG. 5, the pump 152 can, for example, have the inlet 156 connected to receive fluid from the drain box depending on the state of a drain valve 168 and connected to receive cleaning fluid from a reservoir tank 170 depending on the state of a cleaning fluid valve 172.

A water level float 154 will communicate with all pumps to allow for automatic activation of the pumps depending on fluid level. Float design and water level high/low level activation values will vary depending on operational requirements. One or more floats will be utilized and their position will vary depending on design and operational requirements. Multiple pumps can be controlled based on a common float or independently based on separate floats. In the embodiment shown there are two floats 154 located on the platform 122. There could also be water level sensors in the drain boxes, and for example each pump could be controlled based on a water level of a drain box which it drains.

Tubing and hose management has not been shown for clarity purposes. The cleaning fluid can be any suitable fluid, including mixtures or solutions.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A drilling rig leak containment apparatus comprising:

a tray, the tray including a platform and a sidewall around the platform, the tray configured to be positioned around a central stack of a drilling rig;

jet nozzles mounted within the tray;

drain boxes connected to and extending below the platform; and one or more fluid supply pumps connected to supply cleaning fluid to the jet nozzles, each fluid supply pump of the one or more fluid supply pumps having an inlet arranged to connect to a respective drain box of the drain boxes and to connect to a cleaning fluid reservoir, each fluid supply pump also being associated with a respective valve arrangement configured to switch the inlet between connecting to the drain box and connecting to the cleaning fluid reservoir.

2. The drilling rig leak containment apparatus of claim 1 in which each of the one or more fluid supply pumps is in the respective drain box to which its inlet is arranged to connect.

3. The drilling rig leak containment apparatus of claim 1 further comprising one or more additional pumps each arranged to pump fluid from a respective additional drain box of the drain boxes.

4. The drilling rig leak containment apparatus of claim 1 in which the jet nozzles are connected to the one or more fluid supply pumps via one or more manifolds.

5. The drilling rig leak containment apparatus of claim 4 further comprising shut off valves to control flow out of the one or more manifolds.

6. The drilling rig leak containment apparatus of claim 1 in which the pumps are activatable by one or more fluid level sensors.

7. The drilling leak containment apparatus of claim 1 further comprising a flexible sheet-form having a first edge secured to or within the sidewall and a second edge secured in spaced relation to the tray.

8. The drilling leak containment apparatus of claim 7 further comprising additional nozzles connected to the one or more fluid supply pumps and arranged to direct cleaning fluid within the flexible sheet-form.

9. The drilling leak containment apparatus of claim 7 further comprising additional nozzles connected to additional fluid supply pumps and arranged to direct cleaning fluid within the flexible sheet-form.

* * * * *